United States Patent [19]

Tomioka et al.

[11] Patent Number: 4,642,979

[45] Date of Patent: Feb. 17, 1987

[54] APPARATUS FOR ADJUSTING LAY OF WIRE ROPE

[75] Inventors: Hiroyuki Tomioka, Ashiya; Mitsuo Nakata, Suita; Nobuhiro Kusakawa, Ibaragi; Kaname Torigoe, Abiko, all of Japan

[73] Assignee: Shinko Kosen Kogyo Kabushiki Kaisha, Amagasaki, Japan

[21] Appl. No.: 792,882

[22] Filed: Oct. 30, 1985

[30] Foreign Application Priority Data

Nov. 20, 1984 [JP] Japan ..... 59-246436

[51] Int. Cl.[4] ..... D07B 3/02; D07B 3/10; D07B 3/12; D07B 7/00

[52] U.S. Cl. ..... 57/264; 57/6; 57/19; 57/58.52; 57/58.86; 57/265

[58] Field of Search ..... 57/264, 265, 3, 19, 57/6, 58.49–58.57, 58.3–58.38, 58.83–58.86

[56] References Cited

U.S. PATENT DOCUMENTS 3,969,880 7/1976 Maillefer et al. ..... 57/58.52 X
4,498,281 2/1985 Wraight ..... 57/58.34
4,549,394 10/1985 Preussner ..... 57/58.52 X

FOREIGN PATENT DOCUMENTS 58-12803 10/1983 Japan .

*Primary Examiner*—John Petrakes
*Attorney, Agent, or Firm*—Oblon, Fisher, Spivak, McClelland & Maier

[57] ABSTRACT

Method and apparatus for adjusting the lay of a wire rope, in which a torque remaining in the wire rope is detected while the wire rope is drawn out from a reel, and the lay of the wire rope is increased or decreased in accordance with the result of the detection to remove the residual torque; further, the pitch of lay of the wire rope after increasing or decreasing of the lay is measured, then the lay is increased so that the pitch of lay becomes smaller by a predetermined amount than the measured pitch of lay, and the pitch of lay before increasing of the lay is measured continuously in this state. When the residual torque becomes zero in the above torque control, the operation shifts to the above pitch control, and when the measured pitch of lay before increasing of the lay exceeds a predetermined range in the pitch control, the operation shifts to the torque control.

2 Claims, 11 Drawing Figures

APPARATUS FOR ADJUSTING LAY OF WIRE ROPE

BACKGROUND OF THE INVENTION

1. Field of the Invention

The present invention relates to a lay adjusting method and apparatus capable of adjusting the torsion and pitch of a wire rope after use in a simple manner and highly efficiently.

2. Description of the Prior Art

In a wire rope after use, the pitch of lay is increased or decreased in a longitudinal direction and there remains torque. Therefore, for reusing such a wire rope, it is necessary to remove the residual stress, and it is desirable for making the wire rope close to a new rope that the pitch of lay be set somewhat smaller than the state of residual stress being zero. It is also desirable that the residual stress removing operation be performed automatically and that the pitch be set at a predetermined value at the same time. The adjustment of the wire rope pitch and the removal of the residual stress are each performed independently. It has heretofore been considered impossible to effect both operations simultaneously.

SUMMARY OF THE INVENTION

The present invention, which has been accomplished under such technical background, provides a method and apparatus capable in effecting the removal of residual stress (residual torque) of a wire rope and the adjustment of pitch in a highly efficient manner.

The first gist of the present invention resides in a method comprising a first step of detecting the torque remaining in a wire rope while drawing out the wire rope from a reel, and increasing or decreasing the lay of the wire rope in accordance with the detected signal so as to remove the residual torque, and a second step of measuring the pitch of lay of the wire rope after increasing or decreasing of the lay, then increasing the lay so that the pitch of lay becomes smaller by a predetermined amount than the measured pitch of lay, and continuously measuring in this state the pitch lay before increasing of the lay, in which the operation shifts to the second step when the residual torque becomes zero in the first step, and the operation shifts to the first step when the measured pitch of lay before increasing the lay exceeds a predetermined range in the second step.

The second gist of the present invention resides in an apparatus having a wire rope winding reel capable of rotating about its own axis, a laying means which holds said reel rotatably about an axis perpendicular to the axis of the reel, a measuring means for measuring the pitch of lay of a wire rope before and after importing lay to the wire rope, a holding means for holding the wire rope under movement in a U-like loosened condition, a dancer roller engaged with a lower end portion of the U-like loosened wire rope rotatably about a vertical axis, a detecting means for detecting a rotational angle of the dancer roller, and a control means for allowing the laying means to selectively perform either an operation responsive to a detected value provided from the detecting means or an operation responsive to a measured value provided from the measuring means.

DESCRIPTION OF A PREFERRED EMBODIMENT

Figure 1:
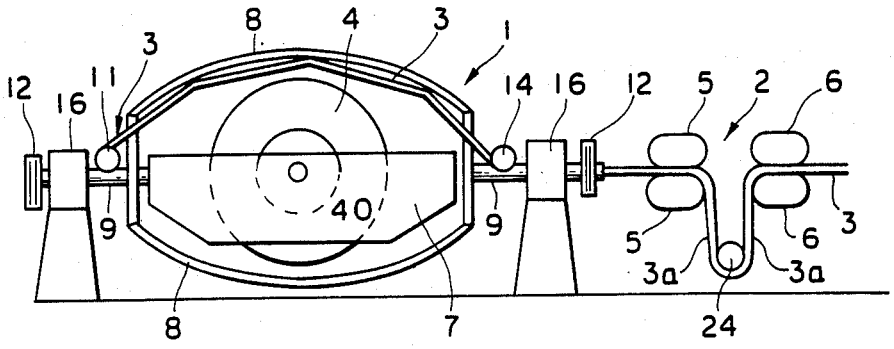
FIG. 1 is a schematic front view showing an embodiment of the present invention.
Figure 3:
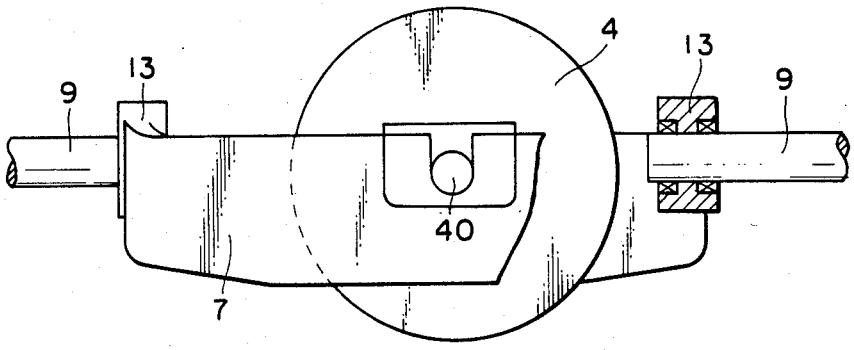
FIG. 3 is a partially cut-away front view of a reel used therein.
Figure 4:
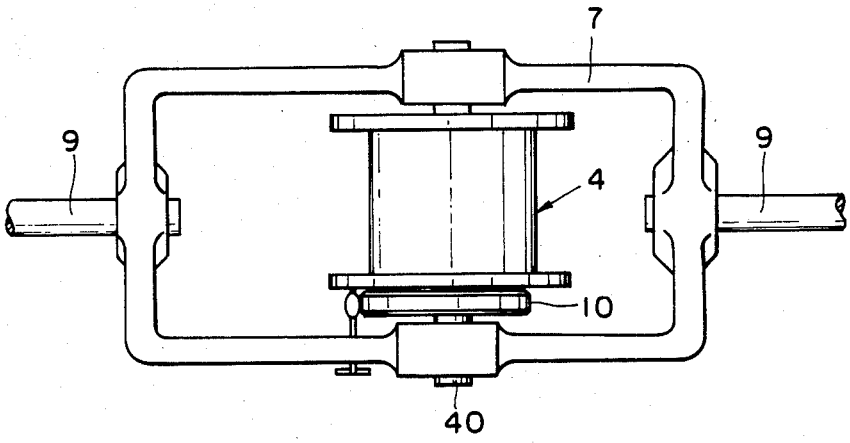
FIG. 4 is a plan view of FIG. 3.
Figure 2:
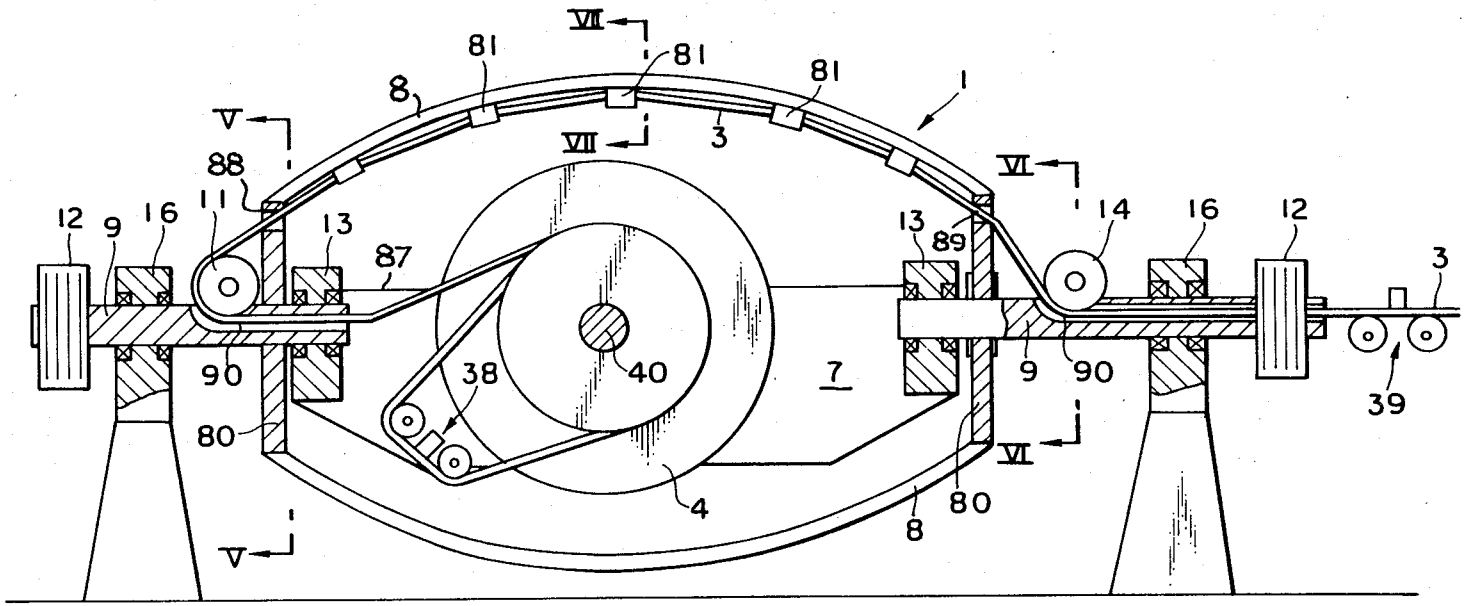
FIG. 2 is a sectional front view of a lay increasing/decreasing device.
Figure 5:
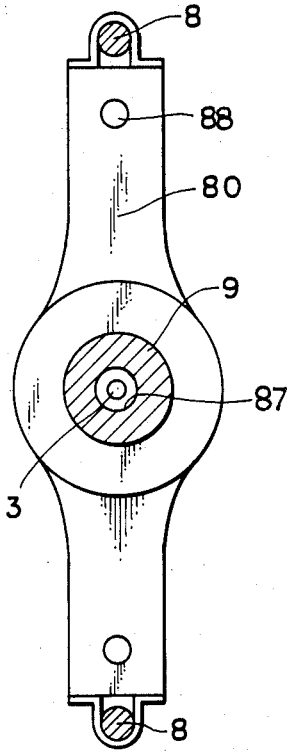
FIG. 5 is a sectional view taken on line V—V of FIG. 2.
Figure 6:
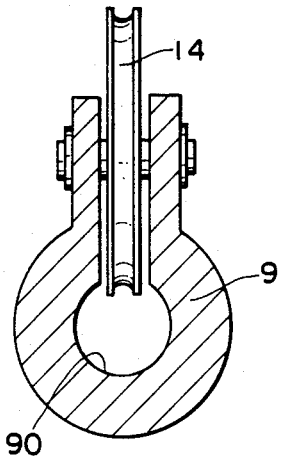
FIG. 6 is a sectional view taken on line VI—VI of FIG. 2.
Figure 7:
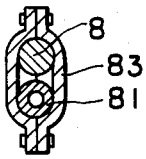
FIG. 7 is a sectional view taken on line VII—VII of FIG. 2.

In FIGS. 1 to 7, the reference numerals 1, 2 and 3 denote a supply and lay increasing/decreasing device, a torque detector and a wire rope, respectively. The wire rope 3 is drawn out from a wire rope winding reel 4, and its lay is increased or decreased by the rotation of an arcuate guide arm 8 while passing through a guide roller 11, the guide arm 8 and a guide roller 14. The wire rope 3 is then delivered through the torque detector 2. Before the wire rope 3 is drawn out from the reel 4, its lay pitch is detected by a lay pitch detecting means 38 which is constituted by a proximity (contactless) switch. Also there is provided a lay pitch detecting means 39 to detect a lay pitch after giving of lay. The lay pitch detecting means 38 and 39 may be so constituted as to detect unevenness of the outer surface of the wire rope 3 by means of a proximity switch.

The supply and lay increasing/decreasing device 1 is supported at both end portions thereof by a pair of shafts 9 which are rotatably supported by a pair of support blocks 16. On each of the shafts 9 is mounted a pulley 12 for rotation of the corresonding shaft 9 and a support member 80 which supports the guide arm 8. Further, bearings 13 of a flyer 7 are mounted on end portions of the shafts 9 opposite to the end portions where the pulleys 12 are mounted. A shaft 40 of the reel 4 is supported rotatably by the flyer 7. The numeral 10 (see FIG. 4) denotes a band brake. An appropriate number of guide pieces 81 are attached to the guide arm 8 by means of clamps 83 (See FIG. 7). The wire rope 3 from the reel 4 passes through a hole 87 formed in one shaft 9, then passes over the guide roller 11, further passes through a hole 88 formed in the adjacent support member 80, the guide pieces 80, and a hole 89 in the other support member 80, and then is taken out through a hole 90 formed in the other shaft 9 via the guide roller 14.

The torque detector 2 includes a pair of guide means. Each guide means comprises a pair of caterpillars 5,5 and 6,6, for holding and transferring the wire rope 3. By these paired guide means, the portion 3*a* of the wire rope 3 therebetween is held in U form at all times, and a dancer roller 24 is engaged with a lower end portion of the U form. As the guide means, the paired caterpillars 5,5 and 6,6 may be replaced by an independent roller, and even in this case the wire rope 3 can be held in U form during its movement.

Figure 8:
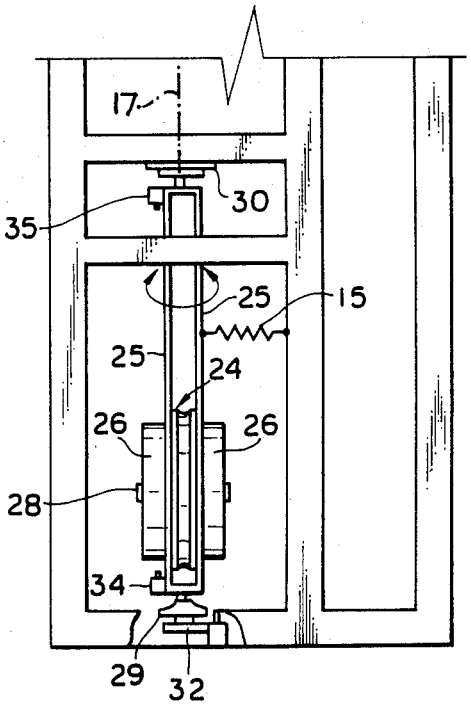
FIG. 8 is a front view of a torque detector.
Figure 9:
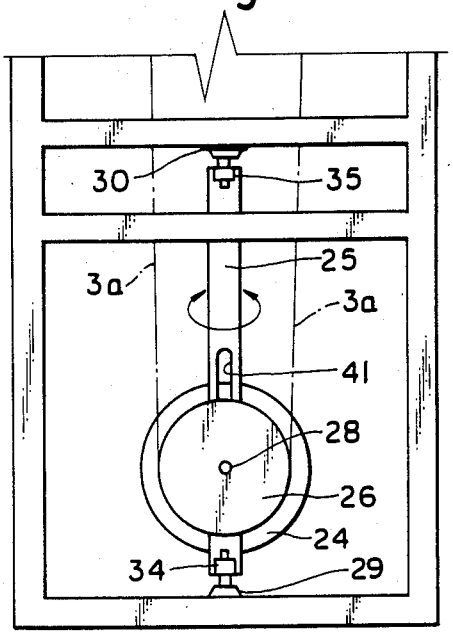
FIG. 9 is a side view thereof.

The dancer roller 24 is of such a construction as shown in FIGS. 8 and 9, in which a shaft 28 of the dancer roller 24 extends through long holes 41 in a frame 25 to thereby hold the dancer roller vertically movably. The frame 25 is supported at its upper and lower end portions for pivotal movement about a vertical axis 17 by means of bearings 29 and 30. A spring 15 biases the frame 25 toward a neutral position, shown in FIG. 8. On both sides of the dancer roller 24 are mounted weights 26 to impart a predetermined tension to the U-shaped portion 3*a*. The numerals 34 and 35 denote limit switches adapted to operate when the dancer roller 24 moves vertically and reaches upper and lower ends. Numeral 32 denotes a rotational angle detector.

The present invention operates as follows. A wire rope after use is drawn out from the reel 4, then passes through the hole 87 in one shaft 9, then over the guide roller 11 and further through the guide pieces 81 in the guide arm 8, then passes through the hole 90 of the other shaft 9 via the guide roller 14 and further through the guide means 5,5 and is loosened in U form. After the dancer roller 24 is brought into engagement with a lower end portion of the U-shaped portion 3*a*, the wire rope 3 is taken out through the guide means 6,6. Since the U-shaped portion 3*a* is transferred while being held at both ends thereof by the guide means 5,5 and 6,6 so as not to cause a slip, it is held at a constant length at all times, and it is held only under a tension induced by the weight of the dancer roller 24 and the weights 26. This weight is for imparting to the U-shaped portion a tension suitable for detecting a residual torque, so it is adjusted by selecting the weights 26 according to the size of wire rope, etc.

Figure 10:
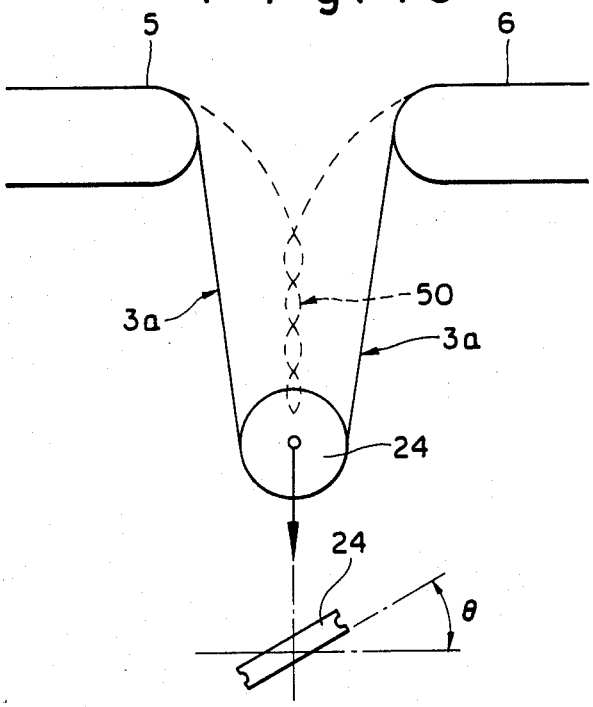
FIG. 10 illustates a principle of the torque detector.

As the wire rope 3 is transferred at a constant speed in this way, a torsion (a torsional portion 50) is apt to occur at the U-shaped portion 3*a* as indicated by broken lines in FIG. 10 if torque remains in the wire rope 3. With this force (torque), the dancer roller 24 rotates about the vertical axis 17. This rotational angle is detected by the angle detector 32, and the shafts 9 are rotated through the pulleys 12 to increase or decrease the lay of the wire rope 3 in accordance with detected direction and amount of the rotation to thereby remove the residual torque in the wire rope 3 (that is, a torque control is performed). Upon detection of a zero torque by the angle detector 32, the above torque control is stopped by a control means (not shown), and the following pitch control is started.

First, a lay pitch in a state of zero torque after increasing or decreasing of lay of the wire rope 4 is detected by the pitch detecting means 39, and a lay is imparted to the wire rope by rotating the supply and lay increasing-/decreasing device 1 through a control means (not shown) so as to give a pitch a little (e.g. 10%) shorter than the lay pitch in that state. In this way, the wire rope 3 is drawn out from the reel 4 while laying it continuously to give a lay pitch shorter by a predetermined amount than in the state of zero torque. At the same time, the lay pitch before the lay impartment is measured continuously by the pitch detecting means 38. When the measured value exceeds a predetermined range (e.g. a variation range of ±20%), this pitch control is switched again to the foregoing torque control by the control means.

Figure 11:
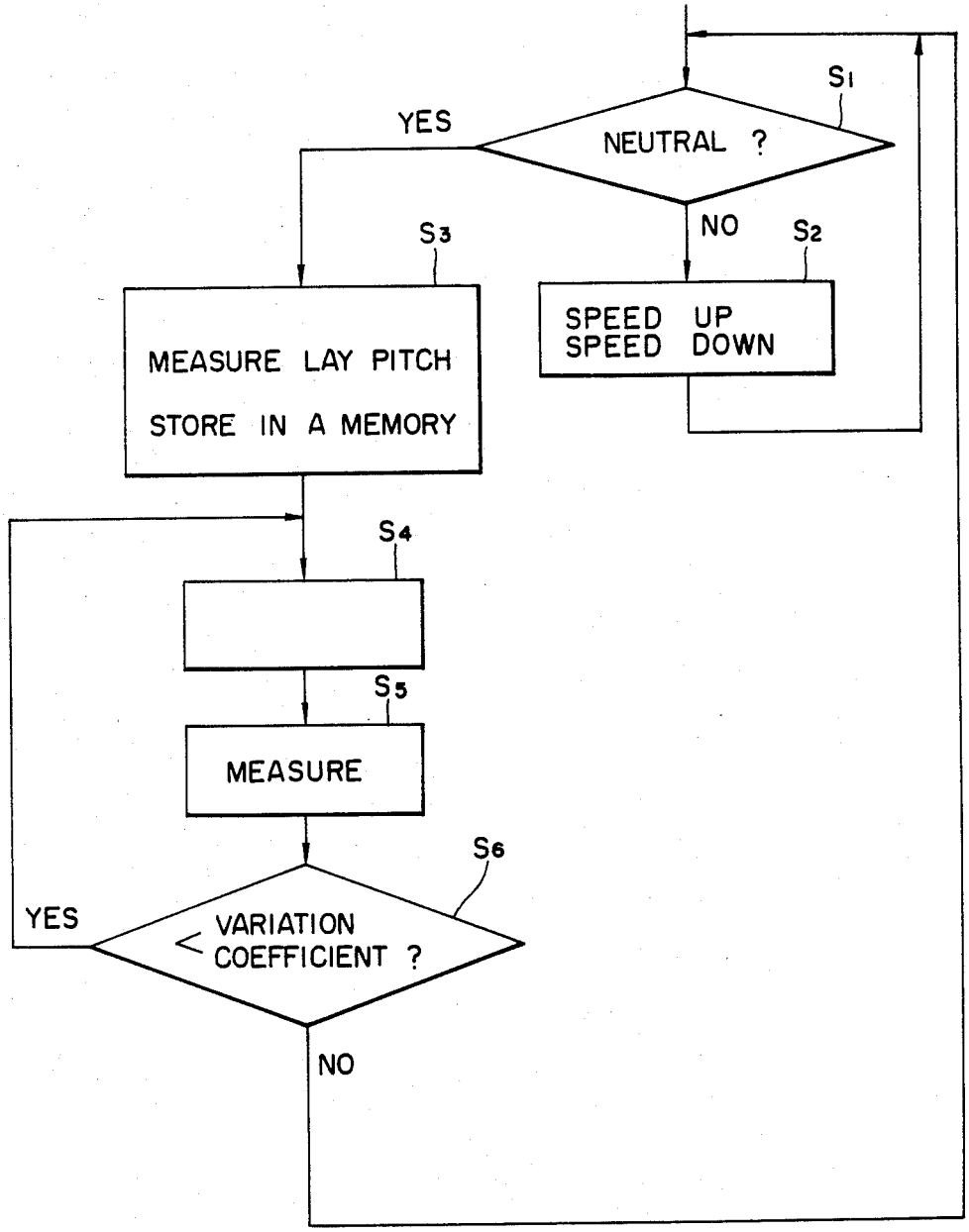
FIG. 11 illustrates how the present invention operates.

These operations will now be explained with reference to the flowchart of FIG. 11. Torque is detected under torque control (step $S_1$), and where the torque is not zero, the rotational speed of the supply and lay increasing/decreasing device 1 is increased or decreased. When the torque becomes zero (neutral), the lay pitch measurement is started by the pitch detecting means 39 (step $S_3$). Then, on the basis of results of this detection, the laying amount is increased so that the lay pitch becomes smaller (overlaid) by a predetermined amount than the detected lay pitch (step $S_4$). In this state, moreover, the lay pitch of the wire rope 3 before the lay impartment is measured by the pitch detecting means 38 (step $S_5$), and the measured value is compared with a predetermined variation coefficient (step $S_6$). If it is below the predetermined variation coefficient, the program returns to step $S_4$ and the above operations are repeated. On the other hand, in the case where the measured value exceeds the predetermined variation coefficient, the program returns to step $S_1$ to perform the torque control.

Overlaying the wire rope in a predetermined range from the state of zero torque is desirable because the residual torque is kept small and the wire rope approaches the state of a new rope. But if the state before the lay impartment changes greatly, there is fear of the amount of residual torque also becoming larger, so there arises the necessity of return to the torque control in the case where the measured value of lay pitch exceeds the predetermined variation. Alternating the torque control and the pitch control as described above is advantageous in that the lay pitch can be returned to a value somewhat smaller than in the state of zero torque, without creating a large residual torque, thus permitting adjustment of the wire rope to a state desirable for its reuse.

According to the present invention, as set forth hereinabove, the torque control and the pitch control is performed alternately while drawing out a wire rope after use from a wire rope winding reel, to adjust the lay pitch of the wire rope into a value somewhat smaller than in the state of zero residual torque. Thus, the removal of stress (torque) remaining in the wire rope as well as the adjustment of pitch can be done in a highly efficient manner.

What is claimed is:

1. Apparatus for simultaneously adjusting the pitch of a wire rope and removing residual stress in the wire rope, said apparatus comprising:

(a) a winding reel (4) mounted for rotation around a first axis (40);

(b) first means for adjusting the pitch of a wire rope (3) paid off said winding reel (4) by imparting a lay to the wire rope (3), said first means comprising:

(i) a first shaft (9) spaced from said winding reel (4) on one side thereof and mounted for pivotal movement around a second axis that is perpendicular to said first axis, said first shaft (9) comprising second means (87) for receiving the wire rope (3) from said winding reel (4) and for guiding it;

(ii) a second shaft (9) spaced from said winding reel (4) on the opposite side thereof from said first shaft (9) and mounted for pivotal movement about a third axis that is at least substantially coincident with said second axis, said second shaft (9) comprising third means (90) for receiving the wire rope (3) from said first shaft (9) and for guiding it;

(iii) fourth means (38) for detecting the pitch of the lay of the wire rope (3) before it is received by said second means (87);

(iv) fifth means (39) for detecting the pitch of the lay of the wire rope (3) after it has left said third means (90);

(v) sixth means (8) for guiding the wire rope (3) from said second means (87) to said third means (90); and (vi) seventh means (7) for rotating said sixth means (8) about said second axis in response to outputs from said fourth means (38) and said fifth means (39);

(c) eighth means for removing residual stress in the wire rope (3), said eighth means comprising:

(i) ninth means (5,5 and 6,6) for receiving the wire rope (3) from said second shaft (9) and for allowing a portion of the wire rope (3) to hang loosely in a U-shape;

(ii) a dancer roller (24) sized, shaped, and positioned so that, in use, the bottom of the U-shaped portion of the wire rope (3) passes around said dancer roller (24), said dancer roller (24) being mounted for both vertical movement and twisting movement about a fourth axis (17) that is vertical and perpendicular both to the first axis and to the second axis in response to variations in the residual stress in the wire rope (3);

(iii) tenth means (32) for detecting residual torque in the wire rope (3) by detecting the rotational angle of said dancer roller (24) about said fourth axis (17); and (iv) eleventh means (12) for rotating said first and second shafts (9) about their respective axes in response to outputs from said tenth means (32); and (d) twelfth means for selectively performing either of the following operations:

(i) rotating said first and second shafts (9) about their respective axes in response to outputs from said tenth means (32) to thereby remove residual torque in the wire rope (3) and, (ii) when an at least approximately zero torque is detected by said tenth means (32), stopping rotating said first and second shafts (9) and imparting a lay to the wire rope (3) by rotating said sixth means (8) in response to outputs from said fourth means (38) and said fifth means (39).

2. Apparatus as recited in claim 1 and further comprising thirteenth means (26) for selectively varying the vertical downward gravitational pull on said dancer roller (24).

* * * * *

UNITED STATES PATENT AND TRADEMARK OFFICE

CERTIFICATE OF CORRECTION

PATENT NO. : 4,642,979

DATED : February 17, 1987

INVENTOR(S) : HIROYUKI TOMIOKA ET AL

It is certified that error appears in the above-identified patent and that said Letters Patent is hereby corrected as shown below:

In column 1, line 32, delete "in" and insert therefor --of--; line 33, delete "of" and insert therefor --in--; line 46, between "pitch" and "lay" insert --of--; line 47, delete "of"; line 57, delete "importing" and insert therefor --imparting--.

In column 2, line 46, delete "corresonding" and insert therefor --corresponding--.

In column 3, line 21, delete "in" and insert therefor --of--; line 22, delete "of" and insert therefor --in--; line 7, delete "movably" and insert therefor --movable--.

In column 4, line 38, delete "is" and insert therefor --are--.

Signed and Sealed this

Thirteenth Day of October, 1987

*Attest:*

DONALD J. QUIGG

*Attesting Officer*

*Commissioner of Patents and Trademarks*